US011648657B2

(12) United States Patent
Barth et al.

(10) Patent No.: US 11,648,657 B2
(45) Date of Patent: May 16, 2023

(54) HANDHELD POWER TOOL

(71) Applicant: Robert Bosch GmbH, Stuttgart (DE)

(72) Inventors: Daniel Barth, Leinfelden-Echterdingen (DE); Manfred Lutz, Filderstadt (DE); Metin Tuerk, Leinfelden-Echterdingen (DE); Peter Stierle, Pliezhausen (DE); Thomas Schomisch, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 1207 days.

(21) Appl. No.: 16/160,415

(22) Filed: Oct. 15, 2018

(65) Prior Publication Data

US 2019/0134802 A1 May 9, 2019

(30) Foreign Application Priority Data

Oct. 19, 2017 (DE) ..... 10 2017 218 668.2

(51) Int. Cl.

| | |
|---|---|
| ***B25F 5/02*** | (2006.01) |
| ***B24B 23/02*** | (2006.01) |
| ***B25F 5/00*** | (2006.01) |
| ***B25F 3/00*** | (2006.01) |

(52) U.S. Cl.

CPC ..... *B25F 5/02* (2013.01); *B24B 23/028* (2013.01); *B25F 5/001* (2013.01); *B25F 3/00* (2013.01)

(58) Field of Classification Search

CPC ..... B25F 5/02; F16H 57/023; B24B 23/028
See application file for complete search history.

(56) References Cited

U.S. PATENT DOCUMENTS

| | | | | |
|---|---|---|---|---|
| 4,474,077 | A * | 10/1984 | Debelius | F16H 57/032 29/451 |
| 5,832,611 | A * | 11/1998 | Schmitz | B25F 5/02 30/392 |
| 2012/0282846 | A1* | 11/2012 | Kuether | B24B 47/12 451/344 |
| 2015/0202738 | A1* | 7/2015 | Boeck | B24B 23/028 451/451 |
| 2019/0015962 | A1* | 1/2019 | Wang | B25F 5/02 |

FOREIGN PATENT DOCUMENTS

| | | | |
|---|---|---|---|
| DE | 25 22 446 | A1 | 12/1976 |
| DE | 27 52 979 | A1 | 6/1978 |
| DE | 37 40 200 | A1 | 6/1989 |
| DE | 41 01 705 | A1 | 3/1992 |
| DE | 196 16 764 | A1 | 11/1997 |
| DE | 10 2010 033 978 | A1 | 2/2012 |
| DE | 10 2011 075 291 | A1 | 3/2012 |
| DE | 10 2013 216 535 | A1 | 2/2015 |
| DE | 10 2014 218 582 | A1 | 3/2015 |
| DE | 10 2014 207 713 | A1 | 10/2015 |

* cited by examiner

*Primary Examiner* — Daniel Jeremy Leeds
(74) *Attorney, Agent, or Firm* — Maginot, Moore & Beck LLP

(57) ABSTRACT

A handheld power tool includes an output shaft, a drive unit, a securing ring, and a securing element. The output shaft is configured to be releasably connected to an insert tool of the handheld power tool. The drive unit is configured to transmit a movement to the output shaft. The securing element is configured to secure the securing ring. The securing element has a recess which is provided to surround the securing ring in the radial direction in at least one operating state.

15 Claims, 8 Drawing Sheets

HANDHELD POWER TOOL

This application claims priority under 35 U.S.C. § 119 to patent application number DE 10 2017 218 668.2, filed on Oct. 19, 2017 in Germany, the disclosure of which is incorporated herein by reference in its entirety.

BACKGROUND

The disclosure relates to a handheld power tool.

DE 2752979 discloses a transmission for an electric angle tool, in particular an angle grinder, for connecting the output shaft of the motor to the delivery shaft, arranged perpendicularly with respect to said output shaft, by means of gear wheels, in particular bevel gears, of which at least in each case one is fastened to each shaft. One of the gear wheels is fixed on the shaft against axial movements by means of a holder arrangement. This holding arrangement is held by means of a Seeger ring which is pressed into a groove in the shaft.

SUMMARY

The disclosure is based on the object of improving a handheld power tool, in particular an angle grinder, using simple structural measures.

The object is achieved by a handheld power tool, in particular an angle grinder, comprising a drive unit for transmitting a movement to an output shaft which can be releasably connected to an insert tool, comprising a securing ring and comprising a securing element for securing the securing ring.

According to the disclosure, the securing element has a recess which is provided to surround the securing ring in the radial direction in at least one operating state.

Owing to the growing number of insert tools and, respectively, accessories for handheld power tools, increasingly higher torques, rotation forces and axial forces which act on the handheld power tools and in particular on the output shafts can also be observed.

Owing to the disclosure, the functional reliability of the handheld power tool is intended to now be increased by a securing ring holding the output shaft in or on the handheld power tool. Furthermore, the available installation space is intended to be used in a more optimal manner.

Furthermore, improved and, respectively, automated assembly can be achieved owing to the disclosure.

In this context, a "drive unit" is intended be understood to mean, in particular, a unit which is provided to generate at least one drive torque and to pass on said drive torque, in particular, to an insert tool. The handheld power tool advantageously has a drive unit. The drive unit particularly advantageously has at least one electric motor. The drive unit is preferably provided to drive and/or to move at least one insert tool, for example a drill and/or a tool bit and/or a cutting blade and/or a grinding disc and/or a scissor blade or the like, and/or at least the output shaft or a tool receptacle device, for example a chuck and/or a saw blade receptacle and/or a bit holder or the like, of the handheld power tool.

In this case, the output shaft can be connected directly or indirectly to the insert tool. In the case of indirect connection of the output shaft to the insert tool, a tool receptacle device can be provided for example, which tool receptacle device receives the insert tool. In the case of direct connection of the output shaft to the insert tool, the output shaft can have, for example, a thread or a connecting means which is provided to receive an insert tool in some other way and releasably connects the insert tool to the handheld work machine.

The securing ring is intended to be provided, in particular, to be fitted onto the output shaft in order to limit an axial movement of components, such as a transmission gear element and/or a bearing element for example, in an interlocking and/or force-fitting manner. The securing ring can be formed from a spring steel. The securing ring can be phosphatized. The securing ring can be lubricated. The securing ring can be designed in accordance with DIN 471. The securing ring can be of c-shaped design.

The recess of the securing element can extend in the circumferential direction around a rotation axis of the output shaft.

The securing element can be designed part of a component which is fitted onto the output shaft. In particular, the securing element can extend along the output axis of the output shaft in the axial direction and surround the securing ring at least in sections. The securing element can surround the securing ring in the circumferential direction around the output axis through 360°.

The output axis is understood to mean a geometric axis and is intended to form, in particular, a rotation axis of the output shaft.

The recess of the securing element can be introduced into a component. The recess can have a maximum radial extent in the radial direction of the output axis, which maximum radial extent is greater, in particular at least by up to 5%, preferably at least by up to 10%, preferably at least by up to 15%, further preferably at least by up to 20%, particularly preferably at least by up to 30%, and/or in particular at most by up to 40%, preferably at most by up to 35%, than a radial extent of a section of the output shaft, which section is surrounded by the recess of the securing element and/or of the securing ring in at least one operating state. The securing element can have a recess surface which delimits the recess in the radial direction of the output axis. The recess surface can be formed substantially concentrically about the output axis in relation to the output shaft. The recess surface can have an axial extent along the output axis, which axial extent is equal to or greater than an axial extent of the securing ring.

The dependent claims specify further expedient developments of the handheld power tool according to the disclosure.

It may be expedient that the recess delimits the securing element at least partially in the radial and/or in the axial direction of the output axis. As a result, the securing ring can be surrounded in a particularly advantageous manner and the functional reliability of the system can be improved. In particular, the securing element can protect the securing ring against damage.

It may further be expedient that the output shaft has a securing groove, which encircles the output shaft, for receiving the securing ring. The securing groove can be designed as an, in particular partial, tapered portion of a diameter of the output shaft. The securing groove can be designed as a securing notch which is provided to receive the securing ring and in particular to receive said securing ring in an interlocking and/or force-fitting manner in the axial direction along the output axis. The recess can be provided to surround the securing groove in the radial direction in at least one operating state. As a result, the securing groove can be particularly reliably protected against damage.

Furthermore, it may be expedient that the securing groove has a bent contour. The contour can be of concave design. The contour can be designed as an indentation in the output shaft. As a result, a notching effect of the output shaft can be minimized. In an alternative embodiment, the securing groove can have an angular contour.

Furthermore, it may be expedient that the securing element and the securing groove form a securing apparatus which is provided to secure the securing ring against independently coming loose in at least one operating state. The securing apparatus comprises the recess with a maximum radius which is smaller than a maximum radius of the securing ring in a state fitted on the output shaft which is not situated in the securing groove. In particular, the recess can surround the securing ring in at least one operating state in such a way that the securing ring is prevented from independently coming loose in the radial direction. The recess can have a maximum radius which is greater than a maximum radius of the securing ring in a state inserted in the securing groove. In other words, the maximum radius of the recess in a section of the output shaft adjacent to the securing groove can be smaller than a radius of the output shaft and the material thickness of the securing ring, so that the securing ring does not independently come loose from the securing groove in an operating state surrounded by the recess. The recess surface of the recess can form a distance from the output shaft, which distance is smaller than a material thickness of the securing ring. As a result, it is particularly advantageously possible to prevent the securing ring from jumping out or slipping out during operation of the handheld power tool. In addition, mounting of the securing ring can be facilitated in a particularly advantageous manner by the securing ring being pushed into an end position in the axial direction over the output shaft by means of the transmission gear element, in order to preferably snap into the securing groove.

The handheld power tool can have a transmission element. The transmission element can be designed as a crown gear element.

It is proposed that the handheld power tool has a bearing element, in particular a roller bearing element, which is provided to support the output shaft, wherein the bearing element is provided to make contact with a transmission gear element or a brake element in the axial direction in at least one operating state. As a result, the transmission gear element can particularly advantageously make contact with the bearing element by the transmission gear element forming a supporting region, in particular a supporting point, a supporting line and/or a supporting surface, in relation to the bearing element, which supporting region is at a distance from the output shaft in the radial direction. Therefore, the supporting region of a transmission element or of a brake element is displaced further radially outward in order to reduce a bending moment, which acts on the output shaft, as a result. Greater bending stiffness of the output shaft can be achieved in this way.

The brake element can be part of a run-down brake, such as an eddy current brake for example, which is arranged between the transmission gear element and the bearing element. The brake element can be connected, in particular in an interlocking manner, to the transmission gear element in a rotationally fixed fashion. The eddy current brake can be designed as a conventional eddy current brake which is known to a person skilled in the art and can be found in the prior art.

It may be expedient that the securing element is designed as a/the transmission gear element or a/the brake element and is formed, in particular, by the transmission gear element or the brake element. In particular, a/the transmission gear element and/or a/the brake element and/or a/the bearing element can be connected to the output shaft by means of an interference fit. A particularly reliable force-fitting connection to the output shaft can be formed in this way.

It is further proposed that the output shaft has a first contact region, in particular a first active surface for a/the bearing element of the drive shaft, and a second contact region, in particular a second active surface for a/the transmission gear element or a/the brake element, wherein the securing groove separates the first contact region from the second contact region. The first and, respectively, the second contact region can be provided, in particular, to serve as active surfaces of the roller bearing element or of the transmission gear element. The first and/or the second contact region can be connected to the associated bearing element or to the associated transmission gear element or brake element by means of an interference fit, so that a force-fitting connection is produced between the output shaft and the roller bearing element or the transmission gear element.

It is further proposed that a/the transmission gear element and/or a/the brake element and a/the bearing element are surrounded by a machine housing.

The securing ring can be formed from a wire. The securing ring can have a constant cross section. The securing ring can be bent around the output axis. The securing ring can have a tensioned and an untensioned state. In the untensioned state, the securing ring can be bent, in particular can be bent in a c shape, in such a way that a radius of the securing ring is smaller than a radius of the output shaft, and/or that a radius of the securing ring is equal to or smaller than a radius of the securing groove of the output shaft. In the tensioned state, the securing ring can have a larger radius than in an untensioned state. In the tensioned state, the securing ring can be fitted onto the output shaft. In the tensioned state, the securing ring, in a state mounted on the output shaft, can have a clamping force which is directed in the radial direction of the output axis.

Furthermore, it is proposed that the securing ring is designed as a circlip.

The disclosure further relates to a securing ring which is designed as a circlip. The securing ring, in particular the circlip, can have a round cross section, such as a circular or an oval or a teardrop-shaped cross section for example. The securing ring, in particular the circlip, can have an angular cross section, such as a square or a rectangular cross section for example. The circlip can be embodied as a round wire circlip. The circlip can have an inside diameter of precisely 10.8 mm, approximately to a manufacturing tolerance. The circlip can be designed in accordance with DIN 7993. The circlip can be of c-shaped design. The circlip can be designed as a segment of a ring. As a result, an installation space in the handheld power tool can be optimized in a particularly simple manner.

BRIEF DESCRIPTION OF THE DRAWINGS

Further advantages can be gathered from the following description of the drawing. The drawing illustrates exemplary embodiments of the disclosure. The drawings, the description and the claims contain numerous features in combination. A person skilled in the art will expediently also look at the features individually and combine them to form useful further combinations. In the drawing:

DETAILED DESCRIPTION

Identical components are provided with the same reference symbols in the following figures.

Figure 1:
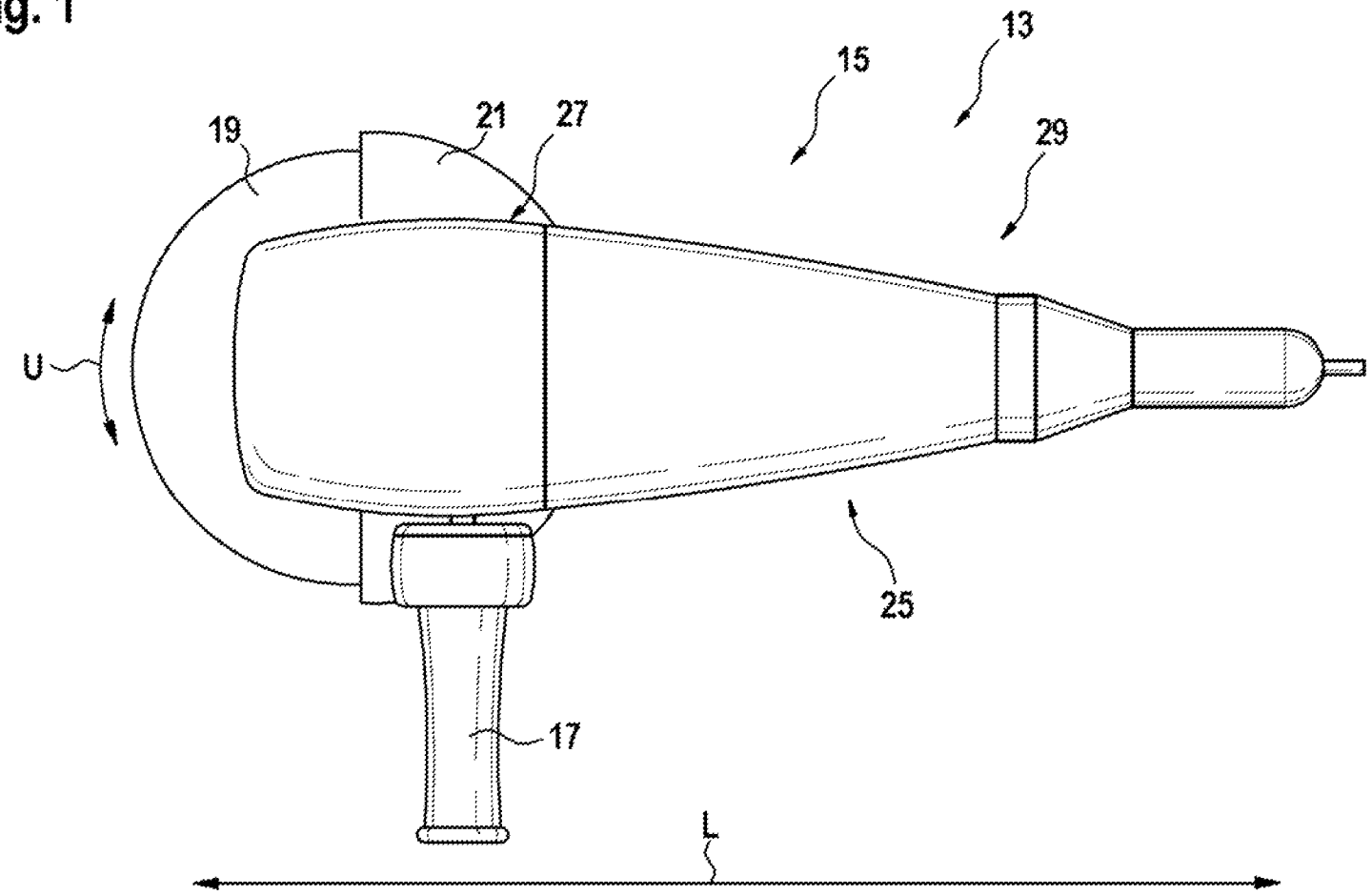
FIG. 1 shows a view of an exemplary handheld power tool 13.

FIG. 1 shows a handheld power tool 13 13, which is designed as an angle grinder 13, comprising a housing 15, comprising an additional handle 17 which is arranged on the housing 15, comprising a cutting disk 19 and comprising a protective hood 21 which surrounds the cutting disk 19 at least in sections.

The cutting disk 19 is designed to cut and/or grind workpieces. The cutting disk 19 can be used universally and is suitable, in particular, for processing workpieces which are composed of cellulose, such as grass, scrub or roots, wood, plastic or a composite for example. However, as an alternative, the cutting disk 19 may also be suitable for processing metal, stone or a composite for example.

The protective hood 21 is intended to be releasably held on rotationally driven commercially available angle grinders 13. The protective hood 21 can be held in a holding apparatus 23, which is already known to a person skilled in the art and is designed to hold the protective hood 21, of a power tool, preferably a handheld power tool 13, with a rotational and/or translatory movement towards a workpiece which is to be processed.

A suitable power tool is a non-stationary handheld power tool 13, such as, for example, an angle grinder 13 or a handheld circular saw according to the application DE 3740200 A1 or such as, for example, a backpack-type brush cutter according to the application DE 19616764 A1.

The housing 15 is designed as a machine housing 25 and comprises a transmission housing 27, which at least partially surrounds a transmission (not shown), in particular an angular transmission, and at least one handle housing 29, which accommodates a drive unit (not shown) at least in sections or at least surrounds said drive unit. The protective hood 21 is expediently intended to cover at least or up to 180° of the cutting disk 19 in order to protect the operator of the angle grinder 13 against flying sparks.

The handheld power tool 13 has a drive unit, not shown, for transmitting a rotational movement U to an output shaft 31 which can be releasably connected to an insert tool 19. The rotational movement U is transmitted from the drive unit to the output shaft 31 by means of a transmission 33 which is designed as an angular transmission 33.

The drive unit has an electric motor. The electric motor can be designed as an electrically commutated motor.

Figure 3B:
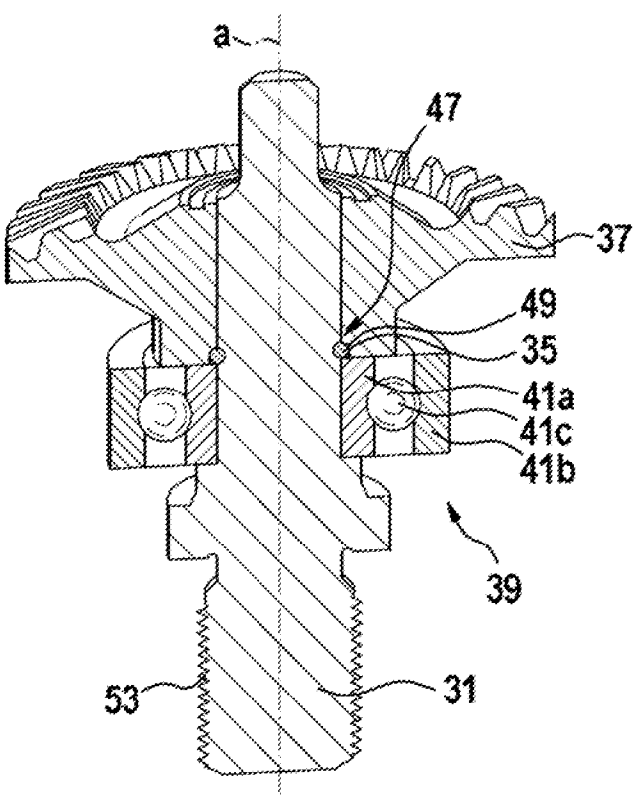
FIGS. 3*a* to 3*b* show two perspective views of an output shaft.
Figure 3A:
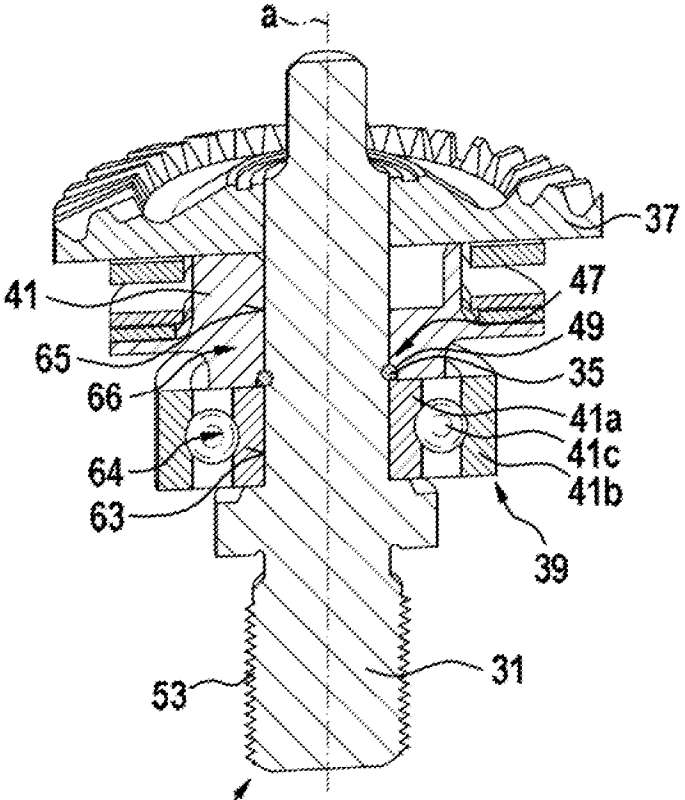

The handheld power tool 13 further has a securing ring 35 which is provided to secure components, such as a transmission gear element 37 and/or a bearing element 39 for example, against axial movement along an output axis a of the output shaft 31. In the present case, the securing ring 35 is intended to minimize and/or delimit the bearing element 39 and a brake element 41 (FIG. 3*a*) or the transmission gear element 37 (FIG. 3*b*) an axial movement along the output axis a.

The bearing element 39 is designed as a roller bearing element 39 which is configured in the form of a conventional ball bearing. The ball bearing 39 has an inner bearing ring 41*a* and an outer bearing ring 41*b* which surrounds the inner bearing ring 41*a*. The outer bearing ring 41*b* is mounted on the inner bearing ring 41*a* by means of balls 41*c* (FIG. 3). In an alternative embodiment, any other roller bearing arrangement which appears to be expedient to a person skilled in the art or a sliding bearing arrangement or the like can also be used.

Figure 2:
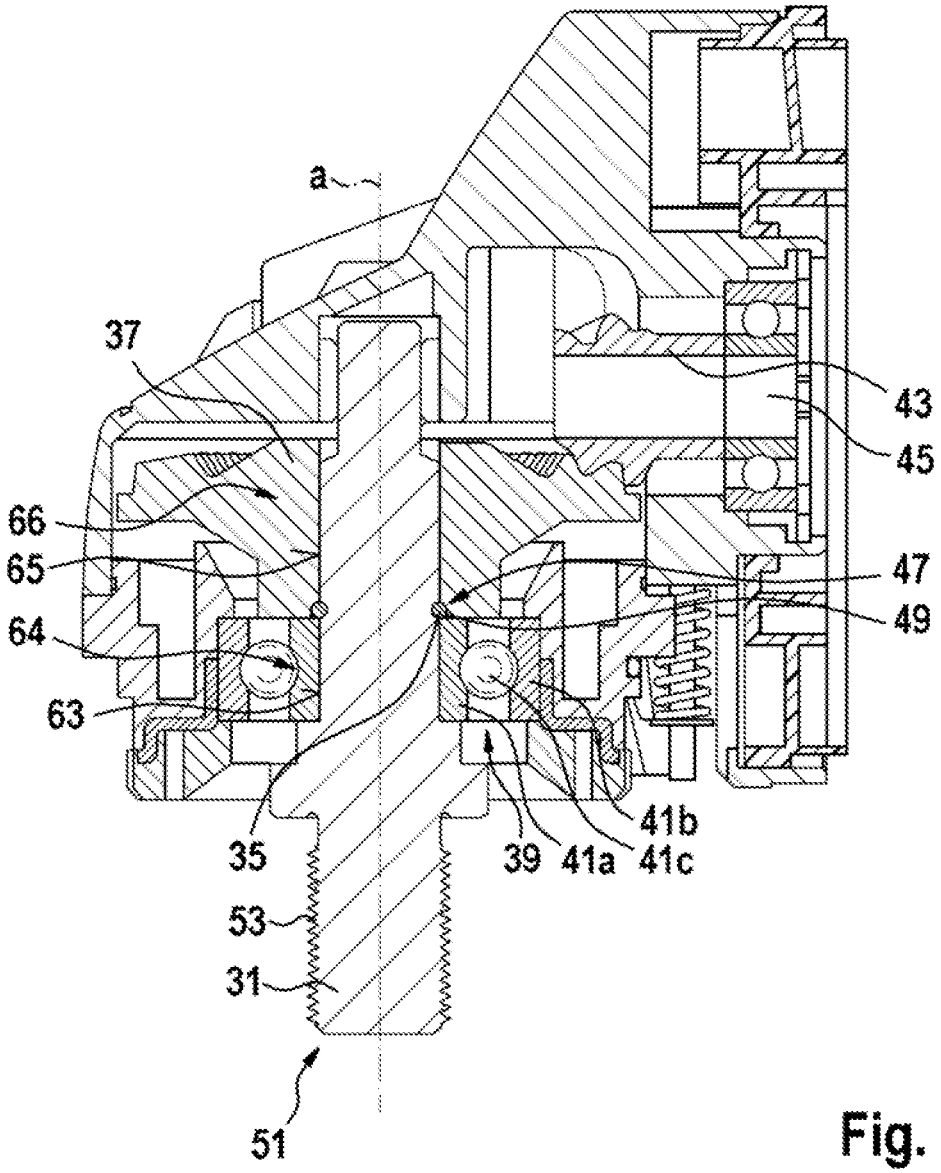
FIG. 2 shows a section through a transmission housing of the handheld power tool 13.

The angular transmission 33 has a crown gear element 37 which forms an interference fit in relation to the output shaft 31 and is pressed onto the output shaft 31. The crown gear element 37 has a helical gearing, so that the crown gear element 37 meshes with a bevel gear element 43 which extends along a longitudinal extent L of the handheld power tool 13 and is directly or indirectly coupled to the drive shaft 45 (FIG. 2). In an alternative embodiment, other angular transmissions 33, such as worm gear transmissions or spur gear transmissions for example, also come into consideration.

The drive shaft 45 is preferably integrally formed with a drive shaft 45 of the drive unit.

The handheld power tool 13 further has a securing element 47 with a recess 49 for securing the securing ring 35. The recess 49 is provided to surround the securing ring 35 in the radial direction in at least one operating state.

The output shaft 31 is be directly connected to the insert tool 19. The output shaft 31 protrudes out of the transmission housing 27 and has a receiving end 51 with a receiving thread 53. The receiving end 51 of the output shaft 31 is provided to detachably receive an insert tool 19 and to be releasably connected to the output shaft 31 by means of a nut (not shown) and the receiving thread 53. As a result, the insert tool 19 can be releasably connected to the handheld power tool 13.

Figure 7A:
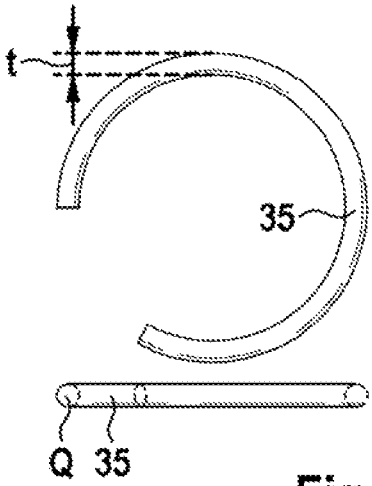
FIG. 7*a* to *e* show several embodiments of securing rings.
Figure 7B:
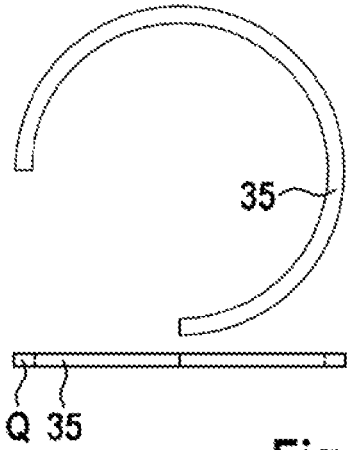
Figure 7C:
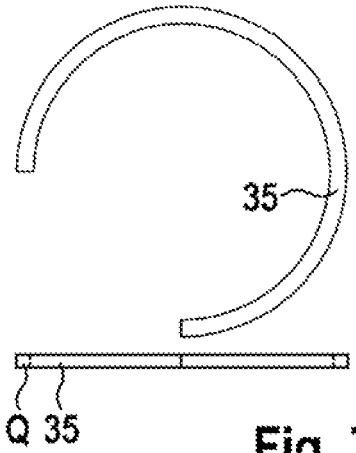
Figure 7D:
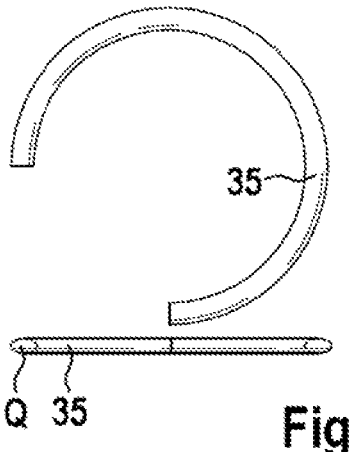
Figure 7E:
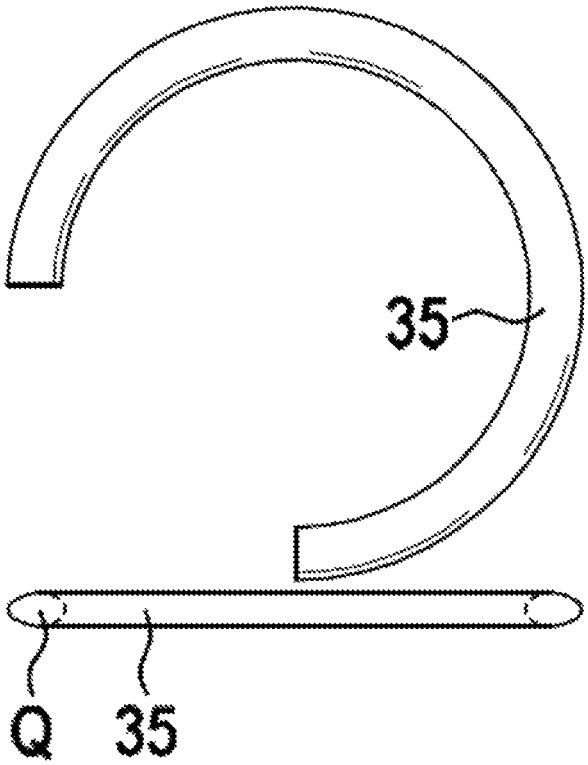

The securing ring 35 is provided to be fitted onto the output shaft 31 in order to limit an axial movement of components, such as a transmission gear element 37 and/or a bearing element 39 for example, in an interlocking and force-fitting manner. The securing ring 35 is formed from a spring steel. The securing ring 35 is phosphatized. The securing ring 35 is lubricated. The securing ring 35 is designed as a circlip 35. The circlip 35 has a circular cross section Q (bottom of FIG. 7*a*). In an alternative embodiment, the circlip 35 can have an angular cross section Q, such as a square (bottom of FIG. 7*b*) or a rectangular (bottom of FIG. 7*c*) cross section Q for example, or a round cross section Q, such as an oval (bottom of FIG. 7*d*) or a teardrop-shaped (bottom of FIG. 7*e*) cross section Q for example.

The circlip 35 is formed from a round wire. The circlip 35 has an inside diameter of exactly 10.8 mm, approximately except for a manufacturing tolerance. The circlip 35 is designed in accordance with DIN 7993. The circlip 35 is of c-shaped design. The circlip 35 is designed as a segment of a ring.

Figure 4A:
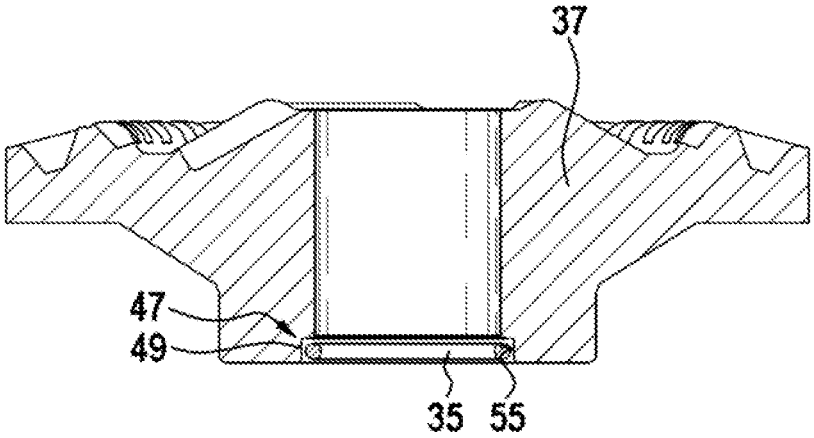
FIGS. 4*a* to 4*b* show two sections through a transmission element and a brake element.
Figure 4B:
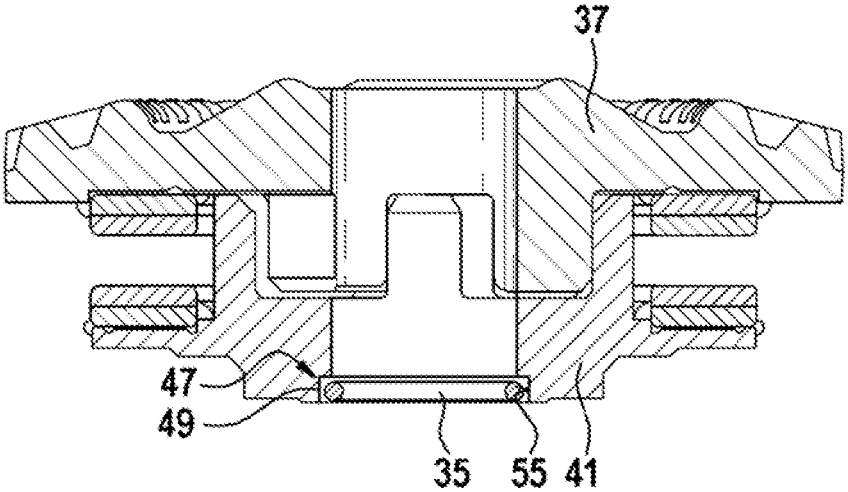
Figure 5:
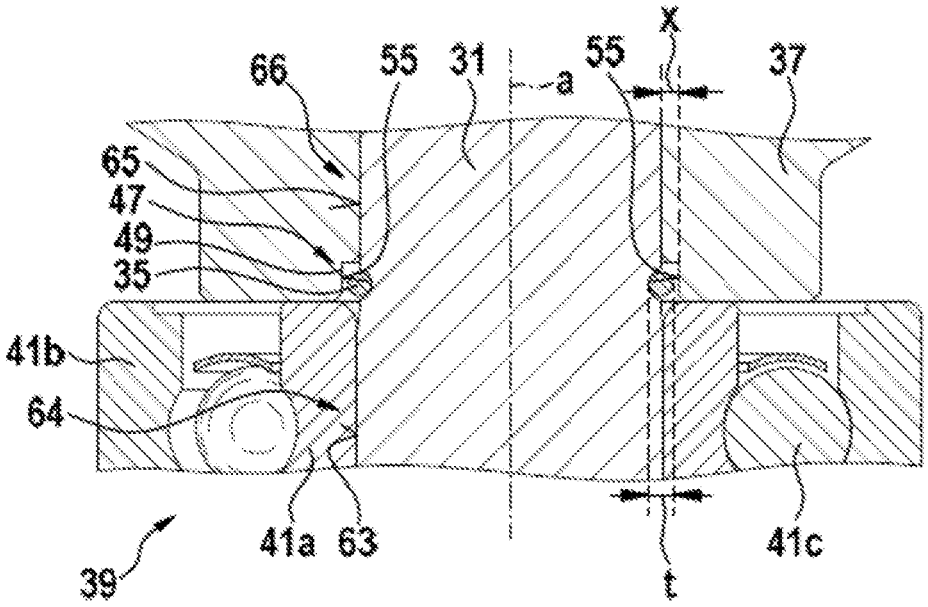
FIG. 5 shows a section through the output shaft from FIG. 3.

The recess 49 of the securing element 47 runs in the circumferential direction U around the output axis a of the output shaft 31. The securing element 47 can be formed by the brake element 41 (FIG. 3*a*, FIG. 4*b*) or the transmission gear element 37 (FIG. 3*b*, FIG. 4*a*) which is fitted onto the output shaft 31 in each case. The securing element 47 extends in the axial direction along the output axis a of the output shaft 31 and surrounds the securing ring 35 at least in sections. The securing element 47 surrounds the securing ring 35 in the circumferential direction U around the output axis a through 360°.

The recess 49 has a maximum radial extent in the radial direction of the output axis a, which maximum radial extent is greater than a radial extent of a section of the output shaft 31 which is surrounded by the recess 49 of the securing element 47 in at least one operating state.

The recess 49 delimits the securing element 47 at least partially in the radial and in the axial direction in relation to the output axis a.

The recess 49 has a recess surface 55 which delimits the recess 49 in the radial direction of the output axis a. The recess surface 55 is designed to be substantially concentric in relation to the output shaft 31 about the output axis a. The recess surface 55 can have an axial extent along the output axis a, which axial extent is greater than an axial extent of the securing ring 35.

Figure 6:
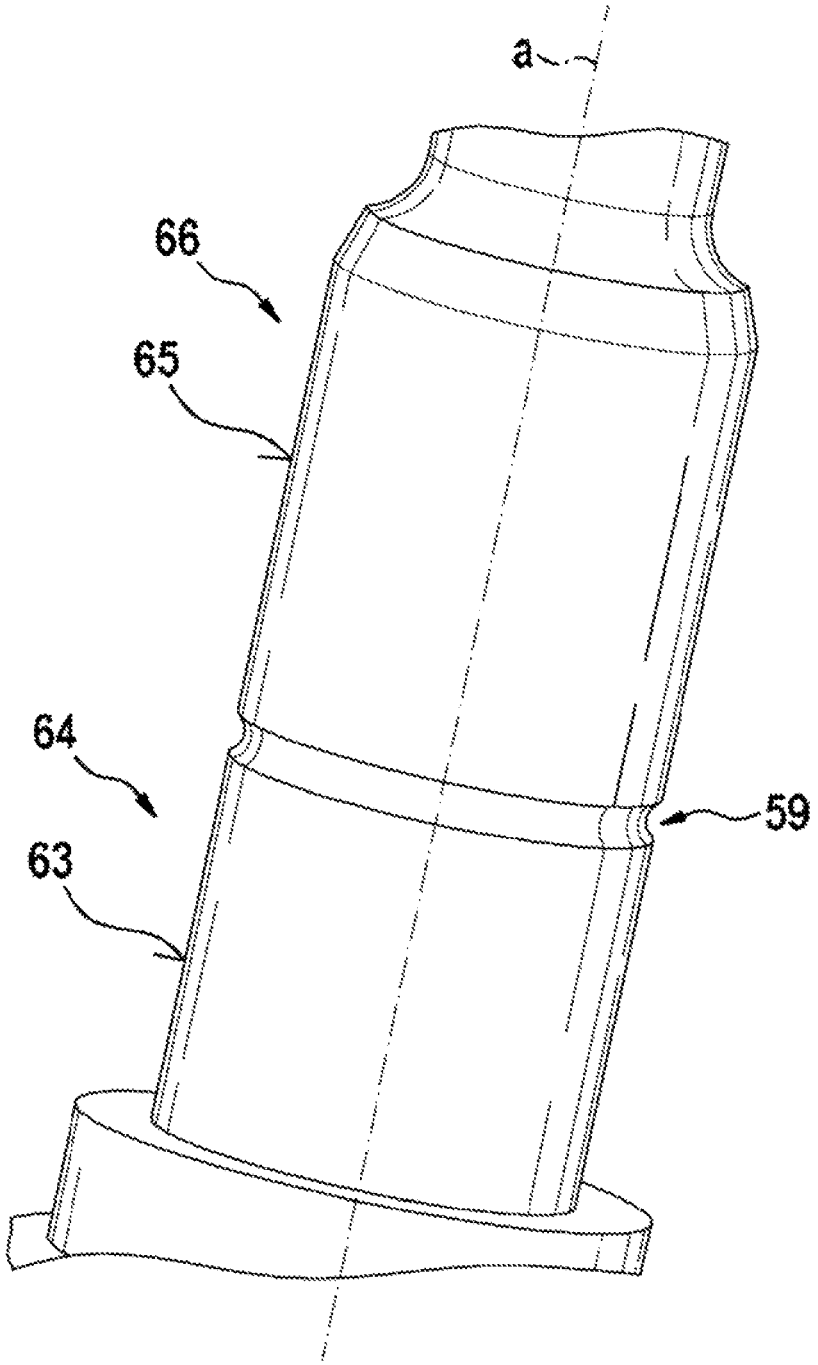
FIG. 6 shows an enlarged view of the output shaft.

The output shaft 31 has a securing groove 57 (FIG. 6), which encircles the output shaft 31, for receiving the securing ring 35. The securing groove 57 is designed as a partial tapered portion of the diameter of the output shaft 31. The securing groove 57 is designed as a securing notch which is provided to receive the securing ring 35 and to hold said securing ring in an interlocking manner in the axial direction along the output axis a. The recess 49 is provided to surround the securing groove 57 in the radial direction in relation to the output axis a in at least one operating state. The securing groove 57 has a round or a concave contour 59 (FIG. 6). In this case, the contour 59, as viewed along the output axis a, steadily tapers and steadily rises again, so that there is no jump in the diameter profile. As a result, the notching effect of the output shaft is minimized.

The securing element 47 has a securing apparatus 61 which is provided to secure the securing ring 35 against independently coming loose in at least one operating state. The securing apparatus 61 comprises the recess 49 with a maximum radius which is smaller than a maximum radius of the securing ring 35 in a state fitted on the output shaft 31 which is not situated in the securing groove 57. The recess 49 surrounds the securing ring 35 in at least one operating state in such a way that the securing ring 35 is prevented from independently coming loose in the radial direction. The recess 49 has a maximum radius which is greater than a maximum radius of the securing ring 35 in a state inserted in the securing groove 57. In other words, the maximum radius of the recess 49 in a section of the output shaft 31 adjacent to the securing groove 57 is smaller than a radius of the output shaft 31 and the material thickness t of the securing ring 35, so that the securing ring 35 cannot independently come loose from the securing groove 57 in an operating state surrounded by the recess 49. The recess surface 55 of the recess 49 can form a distance x from the output shaft 31, which distance is smaller than a material thickness t of the securing ring 35. The securing ring 35 has a constant material thickness t.

The roller bearing element 39 is provided to support the output shaft 31 in a rotatable manner. The roller bearing element 39 makes contact with the crown gear element 37 or the brake element 41 in the axial direction. In the process, the crown gear element 37 can particularly advantageously make contact with the roller bearing element 39 by the transmission gear element forming a supporting region, in particular a supporting point, a supporting line and/or a supporting surface, in relation to the bearing element, which supporting region is at a distance from the output shaft in the radial direction. Therefore, the supporting region of a transmission gear element or of a brake element 41 is displaced further radially outward and reduces a bending moment, which acts on the output shaft 31, as a result.

The output shaft 31 has a first contact region 64, which is designed as a first active surface 63 for the roller bearing element 39, and a second contact region 66, which is designed as a second active surface 65 of the crown gear element 37 or of the brake element 41. The first contact region 64 is separated from the second contact region 66 by the securing groove 57. The first active surface 63 serves as the active surface onto which the roller bearing element 39 is fitted. The second active surface 65 serves as the active surface onto which the crown gear element 37 or the brake element 41 is fitted.

The circlip 35 has a constant cross section. The circlip 35 is bent around the output axis a. The circlip 35 can have a tensioned and an untensioned state. In the untensioned state, the circlip 35 is bent in a c shape in such a way that a radius of the circlip 35 is smaller than a radius of the output shaft, and/or that a radius of the securing ring is equal to or smaller than a radius of the securing groove of the output shaft. In the tensioned state, the securing ring has a larger radius than in an untensioned state. For example, in a tensioned state, the circlip 35 can be arranged on the first contact region 54 or the second contact region 66, as a result of which the radius of the circlip 35 widens. For example, in an untensioned state, the circlip 35 can be arranged in the securing groove 57, so that the radius of the circlip 35 reduces in size.

What is claimed is:

1. A handheld power tool, comprising:

an output shaft configured to be releasably connected to an insert tool, the output shaft defining a securing groove that encircles the output shaft, the output shaft having a flange that extends radially outwardly;

a drive unit configured to transmit a movement to the output shaft;

a securing element defining a recess that is aligned with the securing groove, the securing element being a transmission gear element or a brake element that is configured to brake the transmission gear element;

a securing ring having an inner portion received in the securing groove and an outer portion received in and radially surrounded by the recess so as to secure the securing ring; and a bearing element having a first end that abuts the flange of the output shaft and a second opposite end that is secured by the securing ring.

2. The handheld power tool according to claim 1, wherein the recess delimits the securing element at least partially in at least one of the radial direction and an axial direction of an output axis.

3. The handheld power tool according to claim 1, wherein the securing groove has a bent contour.

4. The handheld power tool according to claim 1, wherein:

the securing element and the securing groove form a securing apparatus, and the securing apparatus is configured to secure the securing ring against independently coming loose in at least one operating state.

5. The handheld power tool according to claim 1, wherein the securing element has a supporting region that contacts the bearing element in an axial direction, the supporting region being radially spaced apart from the output shaft.

6. The handheld power tool according to claim 5, wherein (i) the transmission gear element or the brake element, and/or (ii) the bearing element is connected to the output shaft by an interference fit.

7. The handheld power tool according to claim 1, wherein:

the output shaft has a first contact region forming a first active surface for the bearing element of the drive shaft, the output shaft has a second contact region forming a second active surface for the securing element, and the securing groove separates the first contact region from the second contact region and is adjacent to both the first and second contact regions.

8. The handheld power tool according to claim 1, wherein the bearing element and the one of the transmission gear element and or the brake element are surrounded by a machine housing.

9. The handheld power tool, according to the claim 1, wherein the securing ring is a circlip.

10. The handheld power tool according to claim 1, wherein the handheld power tool is an angle grinder.

11. The handheld power tool according to claim 3, wherein the securing groove has a concave contour.

12. The handheld power tool according to claim 5, wherein the bearing element is a roller bearing element.

13. The handheld power tool according to claim 8, wherein the machine housing is a transmission housing.

14. The handheld power tool according to claim 1, wherein the securing element is the transmission gear element, and the recess is defined in the transmission gear element.

15. The handheld power tool according to claim 1, wherein the securing element is the brake element, and the recess is defined in the brake element.

* * * * *